US007389231B2

(12) United States Patent
Yoshioka et al.

(10) Patent No.: US 7,389,231 B2
(45) Date of Patent: Jun. 17, 2008

(54) VOICE SYNTHESIZING APPARATUS CAPABLE OF ADDING VIBRATO EFFECT TO SYNTHESIZED VOICE

(75) Inventors: Yasuo Yoshioka, Hamamatsu (JP); Alex Loscos, Barcelona (ES)

(73) Assignee: Yamaha Corporation, Hamamatsu-shi (JP)

( * ) Notice: Subject to any disclaimer, the term of this patent is extended or adjusted under 35 U.S.C. 154(b) by 797 days.

(21) Appl. No.: 10/232,802

(22) Filed: Aug. 30, 2002

(65) Prior Publication Data

US 2003/0046079 A1 Mar. 6, 2003

(30) Foreign Application Priority Data

Sep. 3, 2001 (JP) ..... 2001-265489

(51) Int. Cl.
*G10L 13/04* (2006.01)

(52) U.S. Cl. ..... 704/268

(58) Field of Classification Search ..... 704/268
See application file for complete search history.

(56) References Cited

U.S. PATENT DOCUMENTS 4,490,840 A * 12/1984 Jones ..... 704/276
4,862,503 A * 8/1989 Rothenberg ..... 704/235
4,866,777 A * 9/1989 Mulla et al. ..... 704/206
4,957,030 A * 9/1990 Suzuki ..... 84/604
5,444,818 A * 8/1995 Lisle ..... 704/258
5,536,902 A 7/1996 Serra et al. ..... 84/623
5,744,739 A * 4/1998 Jenkins ..... 84/603
5,747,715 A 5/1998 Ohta et al. ..... 84/609
5,781,636 A * 7/1998 Tai ..... 381/62
5,890,115 A * 3/1999 Cole ..... 704/258
6,304,846 B1 * 10/2001 George et al. ..... 704/270
6,316,710 B1 * 11/2001 Lindemann ..... 84/609
6,336,092 B1 * 1/2002 Gibson et al. ..... 704/268
6,362,411 B1 3/2002 Suzuki et al.

(Continued)

FOREIGN PATENT DOCUMENTS

EP 1028409 A2 8/2000

(Continued)

OTHER PUBLICATIONS

Pedro Cano, Alex Loscos, Jordi Bonada, Maarten de Boer, Xavier Serra□□"Voice Morphing System for Impoersonating in Karaoke Applications"□□Aug. 27-Sep. 1, 2000, ICMC2000□□Proceedings of the 2000 International Computer Music Conference.*

(Continued)

*Primary Examiner*—Patrick N. Edouard
*Assistant Examiner*—Eric Yen
(74) *Attorney, Agent, or Firm*—Pillsbury Winthrop Shaw Pittman LLP

(57) ABSTRACT

A voice synthesizing apparatus comprises: a storage device that stores a first database storing a first parameter obtained by analyzing a voice and a second database storing a second parameter obtained by analyzing a voice with vibrato; an input device that inputs information for a voice to be synthesized; a generating device that generates a third parameter based on the first parameter read from the first database and the second parameter read from the second database in accordance with the input information; and a synthesizing device that synthesizes the voice in accordance with the third parameter. A very real vibrato effect can be added to a synthesized voice.

11 Claims, 8 Drawing Sheets

U.S. PATENT DOCUMENTS

| | | | | |
|---|---|---|---|---|
| 6,392,135 | B1 | 5/2002 | Kitayama | 84/622 |
| 6,513,007 | B1 * | 1/2003 | Takahashi | 704/258 |
| 6,615,174 | B1 * | 9/2003 | Arslan et al. | 704/270 |
| 6,810,378 | B2 * | 10/2004 | Kochanski et al. | 704/258 |
| 2002/0184032 | A1 | 12/2002 | Hisaminato | |

FOREIGN PATENT DOCUMENTS

| | | | |
|---|---|---|---|
| EP | 1239457 | A2 | 9/2002 |
| JP | 11-352997 | | 12/1994 |
| JP | 7-325583 | | 12/1995 |
| JP | 9-50287 | | 2/1997 |
| JP | 10-124082 | | 5/1998 |
| JP | 11-282483 | | 10/1999 |
| JP | 2000-221982 | | 8/2000 |
| JP | 2001-22349 | | 1/2001 |
| JP | 2002-073064 | A | 3/2002 |
| JP | HEI 09-44158 | A | 3/2002 |

OTHER PUBLICATIONS

David L. Jones, "Understanding Vibrato: Vocal Principles that Encourage Development", http://web.archive.org/web/20000521203204/http://voiceteacher.com/vibrato.html, May 21, 2000.*

"Vibrato", http://en.wikipedia.org/wiki/Vibrato.*

Michael W. Macon, Leslie Jensen-Link, James Oliverio, Mark A. Clements, E. Bryan George, "Concatenation-based MIDI-to-Singing Voice Synthesis", 103rd AES, Aug. 1997.*

Jordi Bonada, Oscar Celma, Alex Loscos, Jaume Ortola, Xavier Serra, Yasuo Yoshioka, Hiraku Kayama, Yuji Hisaminato, Hideki Kenmochi, "Singing Voice Synthesis Combining Excitation plus Resonance and Sinusoidal plus Residual Models", ICMC 2001.*

Japanese Patent Office Notice for Reason for Rejection, Dated Aug. 20, 2004.

Takeshi Augi, et. al., "Computer Voice Processing" Akiba Shuppan, 1988, pp. 96-98, (partial translation included).

Meron, Y. and Hirose, K., "Synthesis of Vibrato Singing," Department of Information and Communication Engineering, The University of Tokyo, 2000 IEEE, pp. 745-774.

Murray, I. R. et al., "Rule-Based Emotion Synthesis Using Concatenated Speech," ISCA Workshop: Conceptual Framework for Research, Sep. 2000, p. 2, paragraph 2.2.

Greiser, N, Office Communication, European Patent Office, pp. 4, (Apr. 29, 2005).

* cited by examiner

VOICE SYNTHESIZING APPARATUS CAPABLE OF ADDING VIBRATO EFFECT TO SYNTHESIZED VOICE

CROSS REFERENCE TO RELATED APPLICATION

This application is based on Japanese Patent Application 2001-265489, filed on Sep. 3, 2001, the entire contents of which are incorporated herein by reference.

BACKGROUND OF THE INVENTION

A) Field of the Invention

This invention relates to a voice synthesizing apparatus, and more in detail, relates to a voice synthesizing apparatus that can synthesize a singing voice with vibrato.

B) Description of the Related Art

Vibrato that is one of singing techniques is a technique that gives vibration to amplitude and a pitch in cycle to a singing voice Especially, when a long musical note is used, a variation of a voice tends to be poor, and the song tends to be monotonous unless vibrato is added, therefore, the vibrato is used for giving an expression to this.

The vibrato is a high-grade singing technique, and it is difficult to sing with the beautiful vibrato. For this reason, a device as a karaoke device that adds vibrato automatically for a song that is sung by a singer who is not good at singing very much is suggested.

For example, in Japanese Patent Laid-Open No. 9-044158, as a vibrato adding technique, vibrato is added by generating a tone changing signal according to a condition such as a pitch, a volume and the same tone duration of an input singing voice signal, and tone-changing of the pitch and the amplitude of the input singing voice signal by this tone changing signal.

The vibrato adding technique described above is generally used also in a singing voice synthesis.

However, in the technique described above, because the tone changing signal is generated based on a synthesizing signal such as a sine wave and a triangle wave generated by a low frequency oscillator (LFO), a delicate pitch and a vibration of amplitude of vibrato sung by an actual singer cannot be reproduced, and also a natural change of the tone cannot be added with vibrato.

Also, in the prior art, although a wave sampled from a real vibrato wave is used instead of the sine wave, it is difficult to reproduce the natural pitch, amplitude and tone vibrations from one wave to all waves.

SUMMARY OF THE INVENTION

It is an object of the present invention to provide a voice synthesizing apparatus that can add a very real vibrato.

It is another object of the present invention to provide a voice synthesizing apparatus that can add vibrato followed by a tone change According to one aspect of the present invention, there is provided a voice synthesizing apparatus, comprising: a storage device that stores a first database storing a first parameter obtained by analyzing a voice and a second database storing a second parameter obtained by analyzing a voice with vibrato; an input device that inputs information for a voice to be synthesized; a generating device that generates a third parameter based on the first parameter read from the first database and the second parameter read from the second database in accordance with the input information; and a synthesizing device that synthesizes the voice in accordance with the third parameter.

According to the present invention, a voice synthesizing apparatus that can add a very real vibrato can be provided.

Further, according to the present invention, voice synthesizing apparatus that can add vibrato followed by a tone change can be provided.

DETAILED DESCRIPTION OF THE PREFERRED EMBODIMENTS

Figure 1:
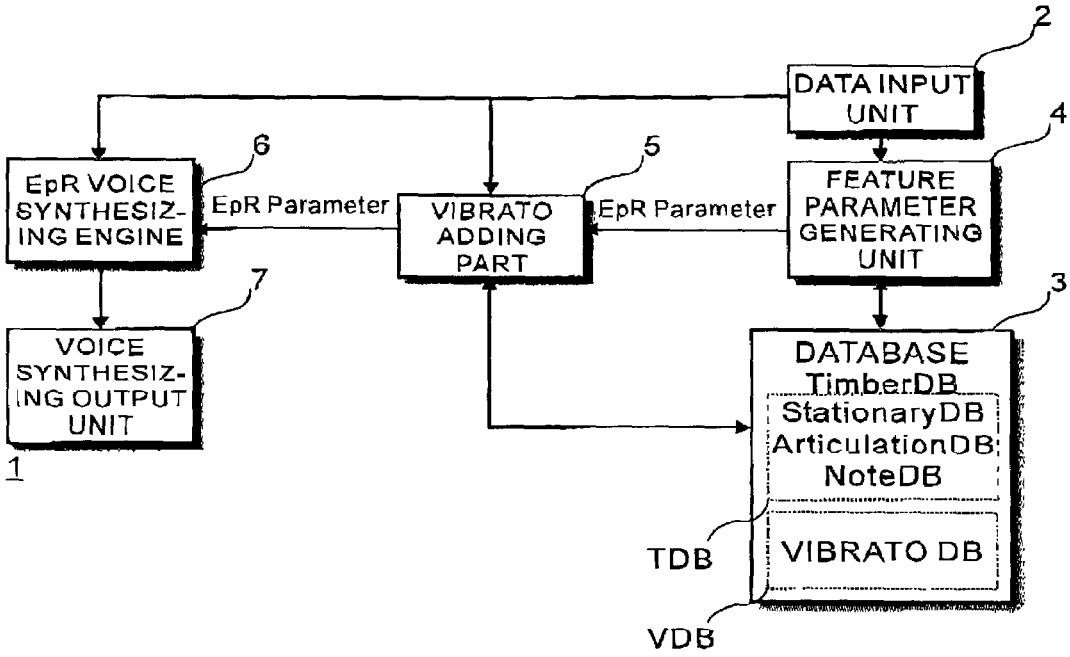
FIG. 1 is a block diagram showing the structure of a voice synthesizing apparatus 1 according to an embodiment of the invention.

FIG. 1 is a block diagram showing the structure of a voice synthesizing apparatus 1 according to an embodiment of the invention The voice synthesizing apparatus 1 is formed of a data input unit 2, a database 3, a feature parameter generating unit 4, a vibrato adding part 5, an EpR voice synthesizing engine 6 and a voice synthesizing output unit 7. The EpR is described later.

Data input in the data input unit 2 is sent to the feature parameter generating unit 4, the vibrato adding part 5 and EpR voice synthesizing engine 6. The input data contains a controlling parameter for adding vibrato in addition to a voice pitch, dynamics and phoneme names or the like to synthesize.

The controlling parameter described above includes a vibrato begin time (VibBeginTime), a vibrato duration (VibDuration), a vibrato rate (VibRate), a vibrato (pitch) depth (Vibrato (Pitch) Depth) and a tremolo depth (Tremolo Depth).

The database 3 is formed of at least a Timbre database that stores plurality of the EpR parameters in each phoneme, a template database TDB that stores various templates representing time sequential changes of the EpR parameters and a vibrato database VDB.

The EpR parameters according to the embodiment of the present invention can be classified, for example, into four types: an envelope of excitation waveform spectrum: excitation resonances; formants; and differential spectrum. These four EpR parameters can be obtained by resolving a spectrum envelope (original spectrum envelope) of harmonic components obtained by analyzing voices (original voices) of a real person or the like.

The envelope (ExcitationCurve) of excitation waveform spectrum is constituted of three parameters, EGain [dB] indicating an amplitude of a glottal waveform; ESlope indicating a slope of the spectrum envelope of the glottal waveform; and ESlopeDepth [dB] indicating a depth from a maximum value to a minimum value of the spectrum envelope of the glottal waveform.

The excitation resonance represents a chest resonance and has the second-order filter characteristics. The formant indicates a vocal tract resonance made of plurality of resonances.

The differential spectrum is a feature parameter that has a differential spectrum from the original spectrum, the differential spectrum being unable to be expressed by the three parameters, the envelope of excitation waveform spectrum, excitation resonances and formants.

The vibrato database VDEB stores later-described vibrato attack, vibrato body and vibrato data (VD) set constituted of a vibrato release.

In this vibrato database VDB, for example, the VD set obtained by analyzing the singing voice with vibrato in various pitch may preferably be stored. By doing that, more real vibrato can be added using the VD set that is the closest of the pitch when the voice is synthesized (when vibrato is added).

The feature parameter generating unit 4 reads out the EpR parameters and the various templates from the database 3 based on the input data. Further, the feature parameter generating unit 4 applies the various templates to the read-out EpR parameters, and generates the final EpR parameters to send them to the vibrato adding part 5.

In the vibrato adding part 5, vibrato is added to the feature parameter input from the feature parameter generating unit 4 by the vibrato adding process described later, and it is output to the EpR voice synthesizing engine 6.

In the EpR voice synthesizing engine 6, a pulse is generated based on a pitch and dynamics of the input data, and the voice is synthesized and output to the voice synthesizing output unit 7 by applying (adding) the feature parameter input from the vibrato adding part 5 to a spectrum of frequency regions converted from the generated pulse.

Further, details of the database 3 except the vibrato database VDB, the feature parameter generating unit 4 and the EpR voice synthesizing engine 6 are disclosed in the embodiment of the Japanese Patent Applications No. 2001-067257 and No. 2001-067258 which are filed by the same applicant as the present invention.

Next, a generation of the vibrato database VDB will be explained First, an analyzing of a voice with vibrato generated by a real person is performed by a method such as a spectrum modeling synthesis (SMS).

By performing the SMS analysis, information (frame information) analyzed into a harmonic component and an inharmonic component at a fixed analyzing cycle is output. Further, frame information of the harmonic component of the above is analyzed into the four EpR parameters described in the above.

Figure 2:
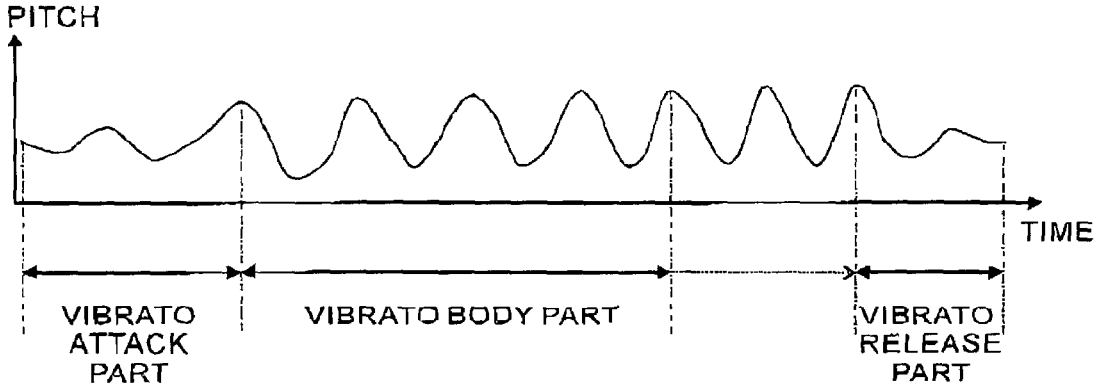
FIG. 2 is a diagram showing a pitch wave of a voice with vibrato.

FIG. 2 is a diagram showing a pitch wave of a voice with vibrato. The vibrato data (VD) set to be stored in the vibrato database VDB consists of three parts into which a voice wave with vibrato as shown in the drawing is divided. The three parts are the vibrato attack part, the vibrato body part and the vibrato release part, and they are generated by analyzing the voice wave using the SMS analysis or the like.

However, vibrato can be added only with the vibrato body part, more real vibrato effect is added by using the above-described two parts: the vibrato attack part and the vibrato body part, or three parts: the vibrato attack part, the vibrato body part and the vibrato release part in the embodiment of the present invention.

The vibrato attack part is, as shown in the drawing, beginning of the vibrato effect; therefore, a range is from a point where a pitch starts to change to a point just before periodical change of the pitch.

A boundary of the ending point of the vibrato attack part is may value of the pitch for a smooth connection with the next vibrato body part.

The vibrato body part is a part of the cyclical vibrato effect followed by the vibrato attack part as shown in the figure. By looping the vibrato body part according to a later-described looping method in accordance with a length of the synthesized voice (EpR parameter) to be added with vibrato, it is possible to add vibrato longer than the length of the database duration.

Further, the beginning and ending points of the vibrato body part are decided to have boundaries at the maximum pints of the pitch change for a smooth connection with a preceding vibrato attack part and a following vibrato release part.

Also, because the cyclical vibrato effect part is sufficient for the vibrato body part, a part between the vibrato attack part and the vibrato release part may be picked up as shown in the figure.

The vibrato release part is the ending point followed by the vibrato body part as shown in the figure and the region from the beginning of the attenuation of the pitch change to the end of the vibrato effect.

Figure 3:
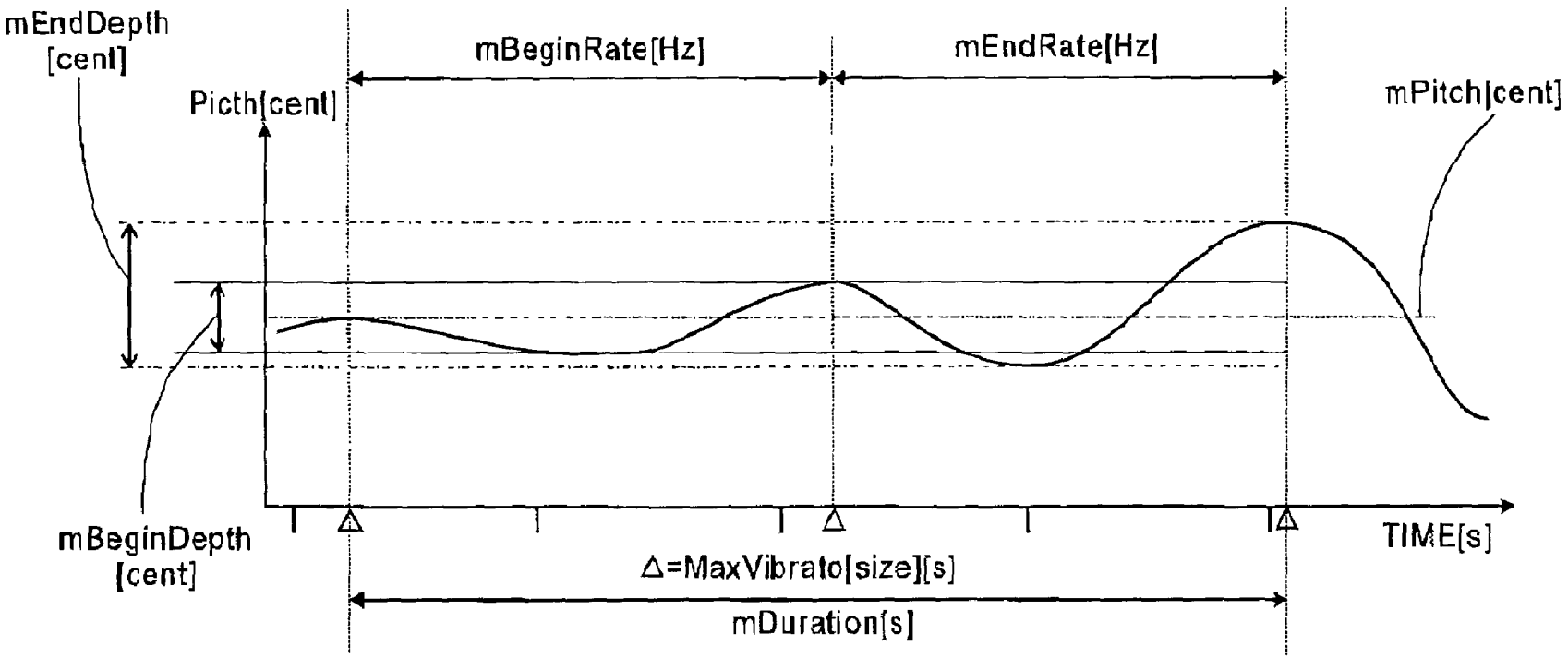
FIG. 3 is an example of a vibrato attack part.

FIG. 3 is an example of a vibrato attack part However, only the pitch with the clearest vibrato effect is showed in the figure, actually the volume and the tone are changed, and these volume and tone colors are also arranged into database by the similar method.

First, a wave of the vibrato attack part is picked up as shown in the figure. This wave is analyzed into the harmonic component and the inharmonic component by the SMS analysis or the like, and further, the harmonic component of them is analyzed into the EpR parameter. At this time, additional information described below in addition to the EpR parameter is stored in the vibrato database VDB.

The additional information is obtained from the wave of the vibrato attack part. The additional information contains a beginning vibrato depth (mBeginDepth [cent]), an ending vibrato depth (mEndDepth [cent]), a beginning vibrato rate (mBeginRate [Hz]), an ending vibrato rate (mEndRate [Hz]), a maximum vibrato position (MaxVibrato [size] [s]), a database duration (mDuration [s]), a beginning pitch (mpitch [cent]), etc And it also contains a beginning gain (mGain [dB]), a beginning tremolo depth (mBeginTremoloDepth [dB]), an ending tremolo depth (mEndTremoloDepth [dB]), etc. which are not shown in the figure.

The beginning vibrato depth (mBeginDepth [cent]) is a difference between the maximum and the minimum values of the first vibrato cycle, and the ending vibrato depth (mEndDepth [cent]) is the difference between the maximum and the minimum values of the last vibrato cycle.

The vibrato cycle is, for example, duration (second) from maximum value of a pitch to next maximum value.

The beginning vibrato rate (mBeginRate [Hz]) is a reciprocal number of the beginning vibrato cycle (1/the beginning vibrato cycle), and the ending vibrato rate (mEndRate [Hz]) is a reciprocal number of the ending vibrato cycle (1/the ending vibrato cycle).

The maximum vibrato position (MaxVibrato [size]) ([s]) is a time sequential position where the pitch change is the maximum, the database duration (mDuration [s]) is a time duration of the database, and the beginning pitch (mpitch [cent]) is a beginning pitch of the first flame (the vibrato cycle) in the vibrato attack area.

The beginning gain (mGain [dB]) is an EGain of the first flame in the vibrato attack area, the beginning tremolo depth (mBeginTremoloDepth [dB]) is a difference between the maximum and minimum values of the EGain of the first vibrato cycle, and the ending tremolo depth (mEndTremoloDepth [dB]) is a difference between the maximum and minimum values of the EGain of the last vibrato cycle.

The additional information is used for obtaining desired vibrato cycle, vibrato (pitch) depth, and tremolo depth by changing the vibrato database VDB data at the time of voice synthesis. Also, the information is used for preventing undesired change when the pitch or gain does not change around the average pitch or gain of the region but changes with generally inclining or declining.

Figure 4:
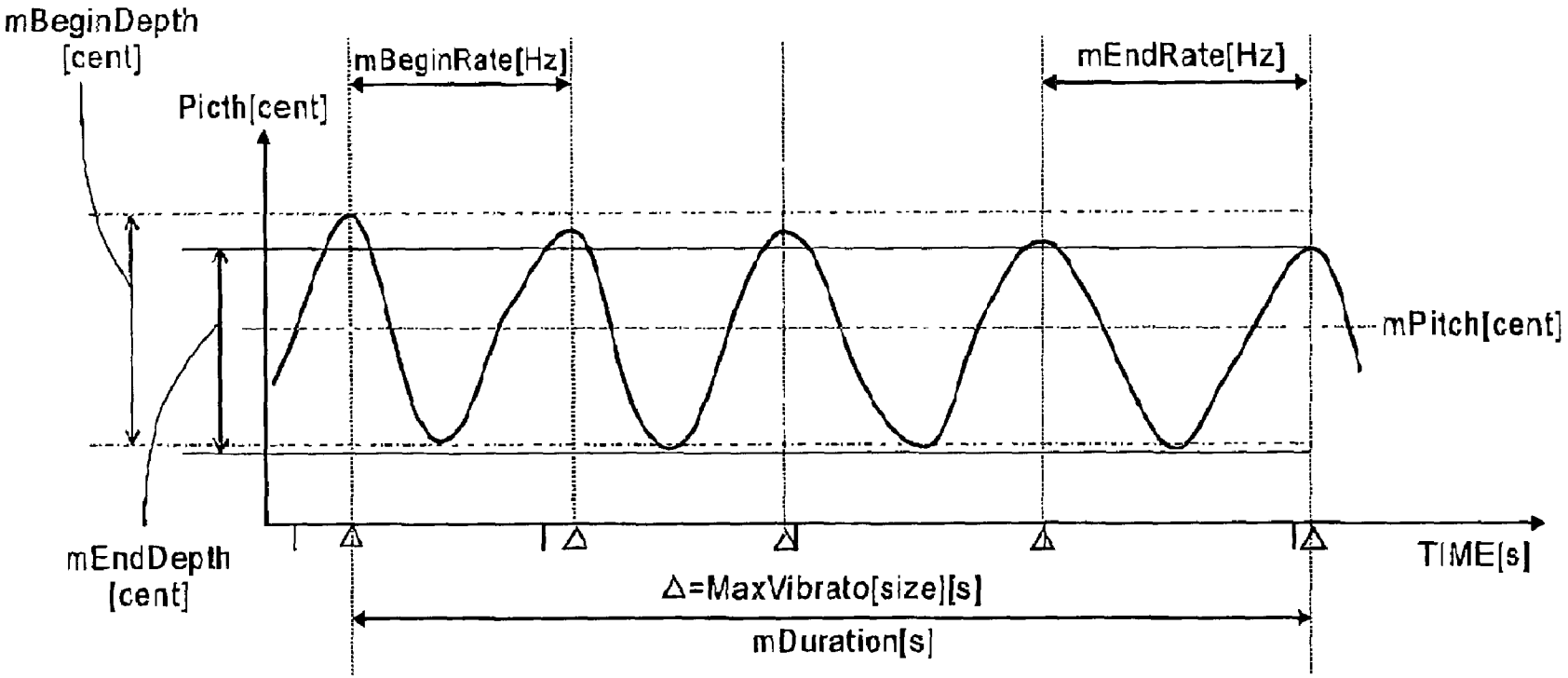
FIG. 4 is an example of a vibrato body part.

FIG. 4 is an example of a vibrato body part. However the pitch with the most remarkable change is shown in this figure as same as in FIG. 2, actually, the volume and the tone color also change, and these volume and tone colors are also arranged into database by the similar method.

First, a wave of the vibrato attack part is picked up as shown in the figure. The vibrato body part is a part changing cyclically following to the vibrato attack part. A beginning and an ending of the vibrato body part is the maximum value of the pitch change with considering a smooth connection between the vibrato attack part and the vibrato release part.

The wave picked up is analyzed into harmonic components and inharmonic components by the SMS analysis or the like. Then the harmonic components from them are further analyzed into the EpR parameters. At that time, the additional information described above is stored with the EpR parameters in the vibrato database VDB as same as the vibrato attack part.

A vibrato duration longer than a database duration of the vibrato database VDB is realized by a method described later to loop this vibrato body part corresponding to the duration to add vibrato.

However it is not shown in figure, the vibrato ending part of the original voice in the vibrato release part is also analyzed by the same method as the vibrato attack part and the vibrato body part is stored with the additional information in the vibrato database VDB.

FIG. 5 is a graph showing an example of a looping process of the vibrato body part. The loop of the vibrato body part will be performed by a mirror loop. That is, the looping starts at the beginning of the vibrato body part, and when it achieves to the ending, the database is read from the reverse side. Moreover, when it achieves to the beginning, the database is read from the start in the ordinal direction again.

Figure 5A:
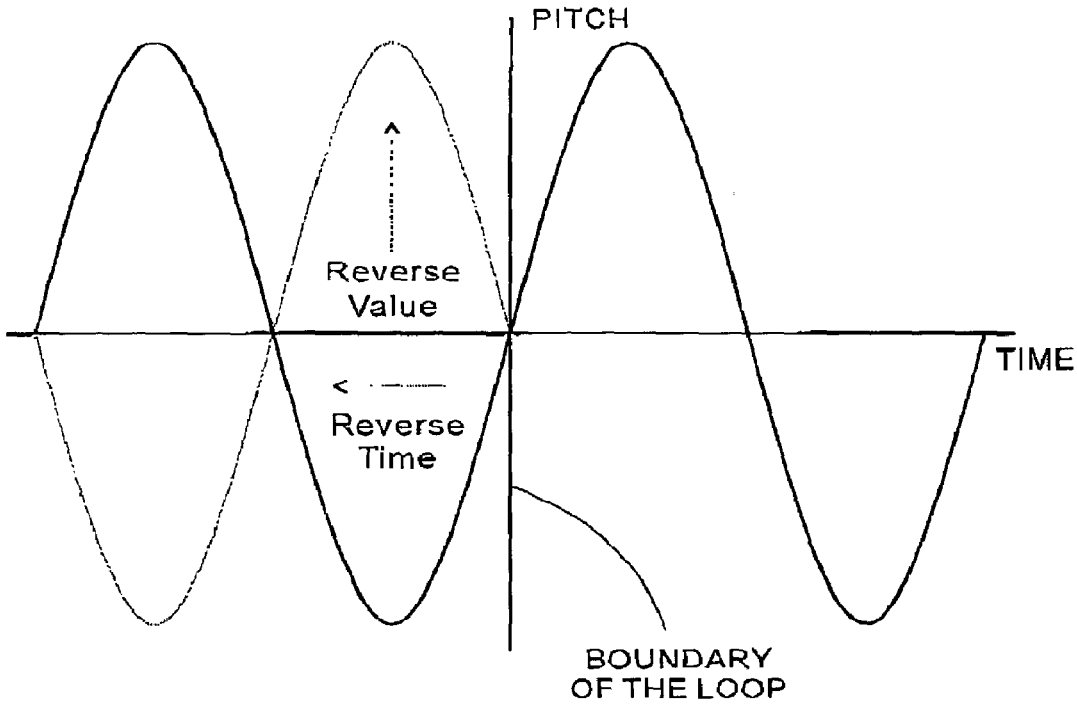
FIG. 5 is a graph showing an example of a looping process of the vibrato body part.

FIG. 5A is a graph showing an example of a looping process of the vibrato body part in the case that the starting and ending position of the vibrato body part of the vibrato database VDB is middle between the maximum and the minimum values of the pitch.

As shown in FIG. 5A, the pitch will be a pitch whose value is reversed at the loop boundary by reversing the time sequence from the loop boundary.

In the looping process in FIG. 5A, a relationship between the pitch and the gain changes because a manipulation is executed to the pitch and gain values at the time of looping process. Therefore, it is difficult to obtain a natural vibrato.

Figure 5B:
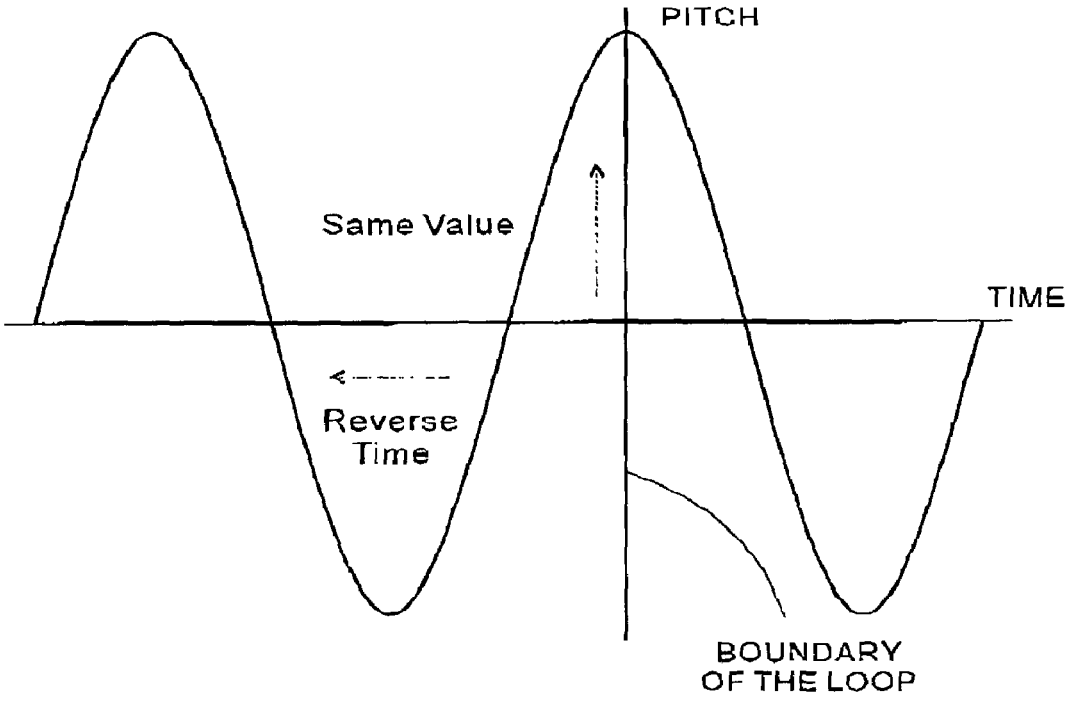

According to the embodiment of the present invention, a looping process as shown in FIG. 5B, wherein the beginning and ending positions of the vibrato body part of the vibrato database VDB is the maximum value, is performed.

FIG. 5B is a graph showing an example of the looping process of the vibrato body part when the beginning and the ending position of the vibrato body part of the vibrato database VDB are the maximum value of the pitch.

As shown in FIG. 5B, however a database is read from the reverse side by reversing the time sequence from the loop boundary position, the original values of pitch and gain are used other than the case in FIG. 5A. By doing that, the relationship between the pitch and the gain is maintained, and a natural vibrato loop can be performed.

Next, a method to add vibrato applying vibrato database VDB contents to a song voice synthesis Δ is explained.

The vibrato addition is basically performed by adding a delta values ΔPitch [cent] and ΔEGain [dB] based on the beginning pitch (mPitch [cent]) of the vibrato database VDB and the beginning gain (mGain [dB]) to the pitch and the gain of the original (vibrato non-added) flame.

By using the delta value as above, a discontinuity in each connecting part of the vibrato attack, the body and the release can be prevented.

At the time of vibrato beginning, the vibrato attack part is used only once, and the vibrato body part is used next. Vibrato longer than the duration of the vibrato body part is realized by the above-described looping process. At the time of vibrato ending, the vibrato release part is used only once. The vibrato body part may be looped till the vibrato ending without using the vibrato release part.

However the natural vibrato can be obtained by using the looped vibrato body part repeatedly as above, using a long duration vibrato body part without repetition than using a short duration vibrato body part repeatedly is preferable to obtain more natural vibrato. That is, the longer the vibrato body part duration is, the more natural vibrato can be added.

But if the vibrato body part duration is lengthened, vibrato will be unstable. An ideal vibrato has symmetrical vibration centered around the average value. When a singer sings a long vibrato actually, it can not be helped to down the pitch and the gain gradually, and the pitch and gain will be leaned.

In this case, if the vibrato is added to a synthesized song voice with the lean, unnatural vibrato being generally leaned will be generated. Further, the looping stands out and the vibrato effect will be unnatural if the long vibrato body is looped by the method described in FIG. 5B because the pitch and gain, which should decline gradually, inclines gradually at the time of the reverse reading.

Figure 6:
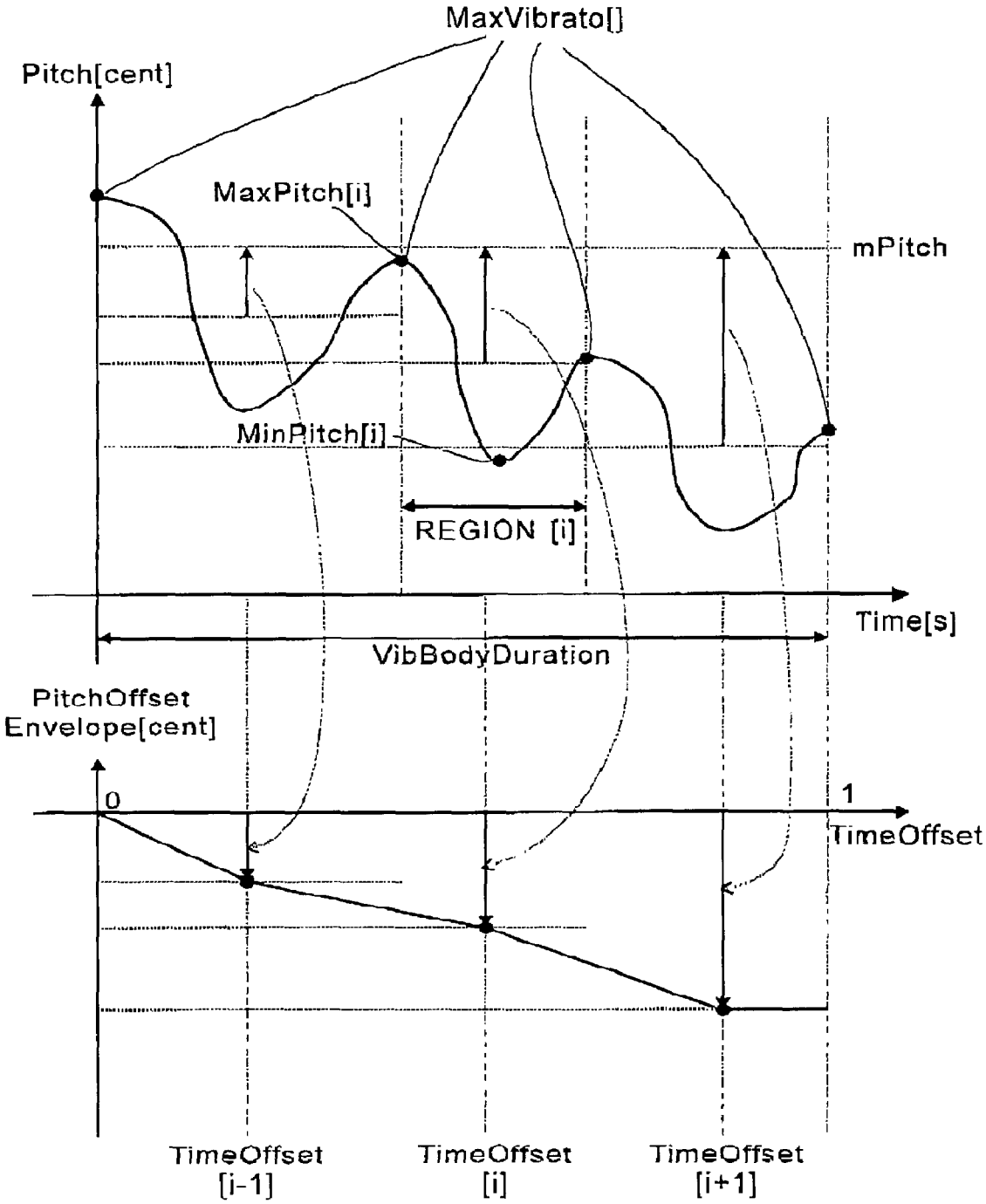
FIG. 6 is a graph showing an example of an offset subtracting process to the vibrato body part in the embodiment of the present invention.

An offset subtraction process as shown in below is performed using the long duration vibrato body part to add a natural and stable vibrato, that is, having ideal symmetrical vibration centered around the average value FIG. 6 is a graph showing an example of an offset subtraction process to the vibrato body part in the embodiment of the present invention. In the figure, an upper part shows tracks of the vibrato body part pitch, and a lower part shows a function PitchOffsetEnvelope (TimeOffset) [cent] to remove the slope of the pitch that the original database has.

First, as shown in the upper part in FIG. 6, database part is divided by a time of the maximum value of the pitch change (MaxVibrato [] [s]). In the number (i) region divided on the above, a value TimeOffset [i] Body which is standardized the center position of the time sequence in the number (i) region by the part duration VibBodyDuration [s] of the vibrato body part is calculated by the equation below. The calculation is performed for all the regions.

$$\text{TimeOffSet}[i]=(\text{MaxVibrato}[i+1]+\text{MaxVibrato}[i])/2/\text{VibBodyDuration} \quad (1)$$

A value TimeOffsetEnvelope (TimeOffset) [i] calculated by the above equation (1) will be a value of a horizontal axis of the function PitchOffsetEnvelope (TimeOffset) [cent] in the graph in the lower part of FIG. 6.

Next, the maximum and the minimum value of the pitch in the number (i) region is obtained, and each of them will be a MaxPitch [i] and a MinPitch [i]. Then a value PitchOffset [i] [cent] of a vertical axis at a position of the TimeOffset [i] is calculated by a equation below (2) as shown in the lower part of FIG. 6.

$$\text{PitchOffset}[i]=(\text{MaxPitch}[i]+\text{MinPitch}[i])/2-m\text{Pitch} \quad (2)$$

Although it is not shown in the drawing, as for EGain [dB], the maximum and the minimum value of the gain in the number (i) region is obtained as same as for the pitch, and each of them will be a MaxEGain [i] and a MinEGain [i] Then a value EGainOffset [i] [dB] of the vertical axis at a position of the TimeOffset [i] is calculated by an equation (3) below.

$$E\text{GainOffset}[i]=(\text{MaxGain}[i]+\text{MinGain}[i]/2-mE\text{Gain} \quad (3)$$

Then a value between the calculated values in each region is calculated by a line interpolation, and a function PichOffsetEnvelope (TimeOffset) [cent] such as shown in the lower part of FIG. 6 is obtained. EGainOffsetEnvelope is obtained as same as for the gain.

In synthesizing song voice, when an elapsed time from the beginning of the vibrato body part is Time [s], a delta value from the above-described mPitch [cent] and mEGain [dB] is added to the present Pitch [cent] and EGain [dB]. Pitch [cent] and EGain [dB] at the database time Time [s] will be DBPitch [cent] and DBEGain [dB], and a delta value of the pitch and the gain is calculated by the equations (4) and (5) below.

$$\Delta\text{pitch}=DB\text{Pitch(Time)}-m\text{Pitch} \quad (4)$$

$$\Delta E\text{Gain}=DBE\text{Gain(Time)}-mE\text{Gain} \quad (5)$$

The slope of the pitch and the gain that the original data has can be removed by offsetting these values by using the equations (6) and (7).

$$\Delta\text{pitch}=\Delta\text{pitch}-\text{PitchOffsetEnvelope(Time/VibBodyDuration)} \quad (6)$$

$$\Delta E\text{Gain}=\Delta E\text{Gain}-E\text{gainOffsetEnvelope(Time/VibBodyDuration)} \quad (7)$$

Finally, a natural extension of the vibrato can be achieved by adding the delta value to the original pitch (Pitch) and gain (EGain) by the equations (8) and (9) below.

$$\text{Pitch}=\text{Pitch}+\Delta\text{Pitch} \quad (8)$$

$$E\text{gain}=\text{Egain}+\Delta E\text{Gain} \quad (9)$$

Next, a method to obtain vibrato having a desired rate (cycle), pitch depth (pitch wave depth) and tremolo depth (gain wave depth) by using this vibrato database VDB is explained.

First, a reading time (velocity) of the vibrato database VDB is changed to obtain the desired vibrato rate by using equations (10) and (11) below.

$$\text{VibRateFactor}=\text{VibRate}/[(m\text{BeginRate}+m\text{EndRate})/2] \quad (10)$$

$$\text{Time}=\text{Time}*\text{VibRateFactor} \quad (11)$$

where VibRate [Hz] represents the desired vibrato rate, and mBeginRate [Hz] and mEndRate [Hz] represent the beginning of the database and the ending vibrato rate. Time [s] represents the starting time of the database as "0".

Next, the desired pitch depth is obtained by an equation (12) below. PitchDepth [cent] represents the desired pitch depth, and mBeginDepth [cent] and mEndDepth [cent] represent the beginning vibrato (pitch) depth and the ending vibrato (pitch) depth in the equation (12). Also, Time [s] represents the starting time of the database as "0" (reading time of the database), and ΔPitch (time) [cent] represents a delta value of the pitch at Time [s].

$$\text{Pitch}\ \Delta\text{pitch(Time)}*\text{PitchDepth}/[(m\text{BeginDepth}+m\text{EndDepth})/2] \quad (12)$$

The desired tremolo depth is obtained by changing EGain [dB] value by an equation (13) below. TremoloDepth [dB] represents the desired tremolo depth, and mBeginTremoloDepth [dB] and mEndTremoloDepth [dB] represent the beginning tremolo depth and the ending tremolo depth of the database in the equation (13). Also, Time [s] represents the starting time of the database as "0" (reading time of the database), and ΔEGain (time) [dB] represents a delta value of EGain at Time [s].

$$E\text{gain}=E\text{gain}+\Delta E\text{Gain(Time)}*\text{TremoloDepth}/[(m\text{BeginTremoloDepth}+m\text{EndTremoloDepth})/2] \quad (13)$$

However methods to change the pitch and the gain are explained in the above, as for ESlope, ESlopeDepth, etc other than them, a reproduce of a tone color change along with the vibrato which original voice has becomes possible by adding the delta value as same as for the pitch and the gain. Therefore, a more natural vibrato effect can be added.

For example, the way of the change in the slope of the frequency character along with the vibrato effect will be the same as that of the change by adding ΔESlope value to ESlope value of the flame of the original synthesized song voice.

Also, for example, reproduce of a sensitive tone color change of the original vibrato voice can be achieved by adding delta value to the parameters (amplitude, frequency and band width) of Resonance (excitation resonance and formants).

Therefore, reproduce of a sensitive tone color change or the like of the original vibrato voice become possible by manipulating the process to each EpR parameters as same as to the pitch and the gain.

Figure 7:
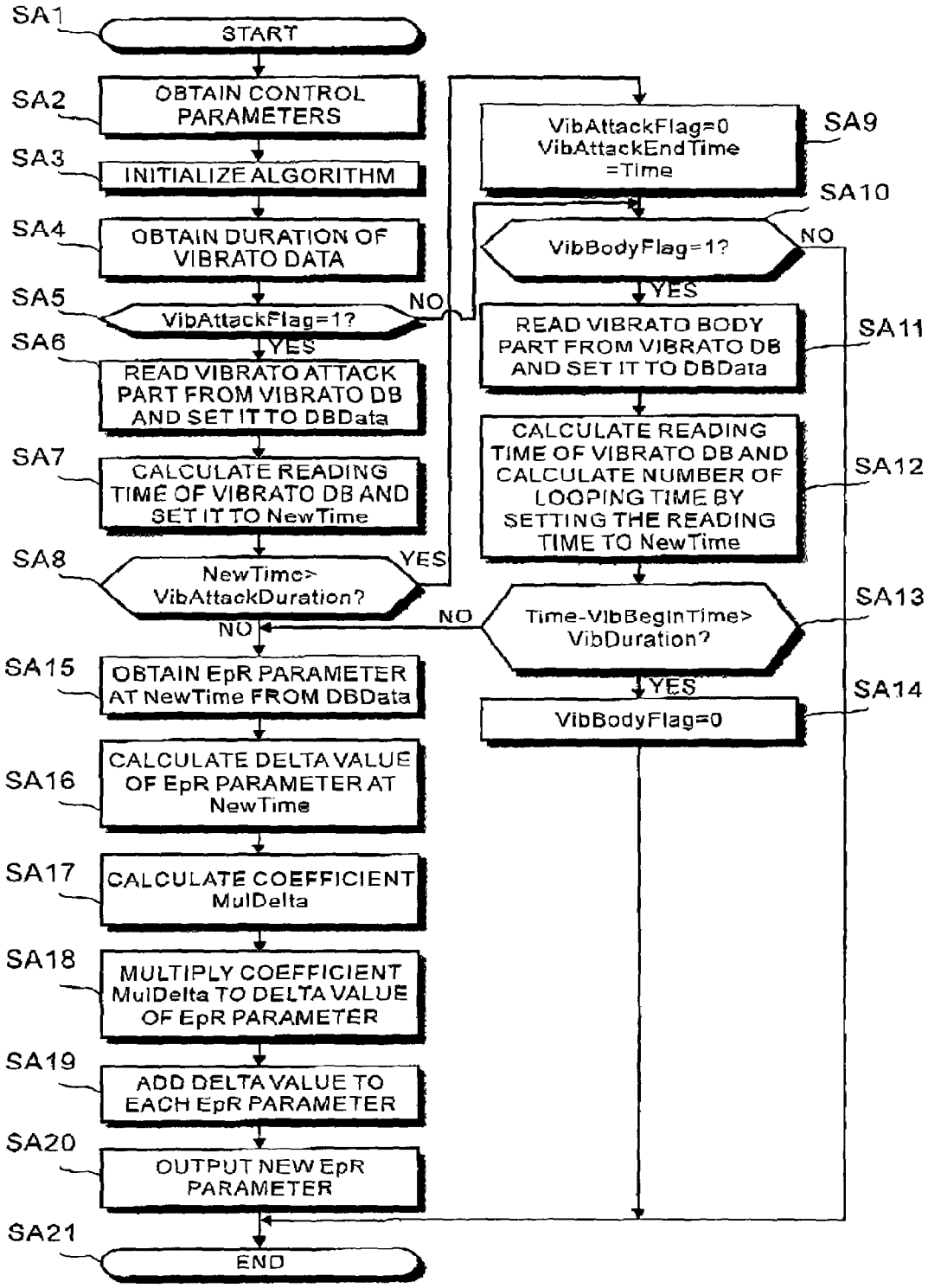
FIG. 7 is a flow chart showing a vibrato adding process in the case that a vibrato release performed in a vibrato adding part 5 of a voice synthesizing apparatus in FIG. 1 is not used.

FIG. 7 is a flow chart showing a vibrato adding process in the case that a vibrato release performed in a vibrato adding part 5 of a voice synthesizing apparatus in FIG. 1 is not used, EpR parameters at the current time Time [s] is always input in the vibrato adding part 5 from the feature parameter generating unit 4.

At Step SA1, the vibrato adding process is started, and the process proceeds to Step SA2.

Control parameters to add vibrato input from the data input part 2 in FIG. 1 are obtained at Step SA2. The control parameters to be input are, for example, a vibrato beginning time (VibBeginTime), a vibrato duration (VibDuration), a vibrato rate (VibRate), a vibrato (pitch) depth (Vibrato (Pitch) Depth) and a tremolo depth (TremoloDepth). Then, the process proceeds to Step SA3.

The vibrato beginning time (VibBeginTime [s]) is a parameter to designate a time for starting the vibrato effect, and a process after that in the flow chart is started when the current time reaches the starting time. The vibrato duration (VibDuration [s]) is a parameter to designate duration for adding the vibrato effect.

That is, the vibrato effect is added to EpR parameter provided from the feature parameter generating unit 4 between Time [s]=VibBeginTime [s] to Time [s]=(VibBeginTime [s]+VibDuration [s]) in this vibrato adding part 5.

The vibrato rate (VibRate [Hz]) is a parameter to designate the vibrato cycle. The vibrato (pitch) depth (Vibrato (Pitch) Depth [cent]) is a parameter to designate a vibration depth of the pitch in the vibrato effect by cent value. The tremolo depth (TremoloDepth [dB]) is a parameter to designate a vibration depth of the volume change in the vibrato effect by dB value.

At Step SA3, when the current time is Time [s]=VibBeginTime [s], an initialization of algorithm for adding vibrato is performed. For example, flag VibAttackFlag and flagVibBodyFlag are set to "1". Then the process proceeds to Step SA4.

At Step SA4, a vibrato data set matching to the current synthesizing pitch is searched from the vibrato database VDB in the database 3 in FIG. 1 to obtain a vibrato data duration to be used. The duration of the vibrato attack part is set to be VibAttackDuration [s], and the duration of the vibrato body part is set to be VibBodyDuration [s]. Then the process proceeds to Step SA5.

At Step SA5, flag VibAttackFlag is checked. When the flag VibAttackFlag=1, the process proceeds Step SA6 indicated by an YES arrow. When the flag VibAttackFlag=0, the process proceeds Step SA10 indicated by a NO arrow.

At Step SA6, the vibrato attack part is read from the vibrato database VDB, and it is set to be DBData. Then the process proceeds to Step SA7.

At Step SA7, VibRateFactor is calculated by the above-described equation (10). Further, the reading time (velocity) of the vibrato database VDB is calculated by the above-described equation (11), and the result is set to be NewTime [s]. Then the process proceeds to Step SA8.

At Step SA8, NewTime [s] calculated at Step SA7 is compared to the duration of the vibrato attack part VibAttackDuration [s]. When NewTime [s] exceeds VibAttackDuration [s] (NewTime [s]>VibAttackDuration [s]), that is, when the vibrato attack part is used from the beginning to the ending, the process proceeds Step SA9 indicated by an YES arrow for adding vibrato using the vibrato body part. When NewTime [s] does not exceed VibAttackDuration [s], the process proceeds to Step SA15 indicated a NO arrow.

At Step SA9, the flag VibAttacKFlag is set to "0", and the vibrato attack is ended. Further, the time at that time is set to be VibAttackEndTime [s], then the process proceeds to Step SA10.

At Step SA10, the flag VibBodyFlag is checked. When the flag VibBodyFlag=1, the process proceeds to Step SA11 indicated by an YES arrow. When the flag VibBodyFlag=0, the vibrato adding process is considered to be finished, and the process proceeds to Step SA21 indicated by a NO arrow.

At Step SA11, the vibrato body part is read from the vibrato database VDB, and it is set to be DBData. Then the process proceeds to Step SA12.

At Step SA12, VibRateFactor is calculated by the above equation (10). Further, the reading time (velocity) of the vibrato database VDB is calculated by equations described in below (14) to (17), and the result is set to be NewTime [s]. The below equations (14) to (17) are the equations to mirror-loop the vibrato body part by the method described before. Then the process proceeds to Step SA13.

$$\text{NewTime}=\text{Time}-\text{VibAttackEndTime} \tag{14}$$

$$\text{NewTime}=\text{NewTime}*\text{VibRateFactor} \tag{15}$$

$$\text{NewTime}=\text{NewTime}-((\text{int})(\text{NewTime}/(\text{VibBodyDuration}*2)))*(\text{VibBodyDuration}*2) \tag{16}$$

$$\text{if}(\text{NewTime}>=\text{VibBodyDuration})\ [\text{NewTime}=\text{VibBodyDuration}*2-\text{NewTime}] \tag{17}$$

At Step SA13, it is detected whether a lapse time (Time−VibBeginTime) from the vibrato beginning time to the current time exceeds the vibrato duration (VibDuration) or not. When the lapse time exceeds the vibrato duration, the process proceeds to Step SA14 indicated by an YES arrow. When the lapse time does not exceed the vibrato duration, the process proceeds to Step SA15 indicated by a NO arrow.

At Step SA14, the flag VibBodyFlag is set to "0". Then the process proceeds to Step SA21.

At Step SA15, Epr parameter (Pitch, EGain, etc.) at the time New time [s] is obtained from DBData. When the time NewTime [s] is the center of the flame time in an actual data in DBData, the EpR parameters in the frames before and after the time NewTime [s] is calculated by an interpolation (e.g., the line interpolation). Then, the process proceeds to Step SA16.

When the process has been proceeded by following the "NO" arrow at Step SA8, DBData is the vibrato attack DB. And when the process has been preceded by following the "NO" arrow at Step SA13. DBData is the vibrato body DB.

At Step SA16, a delta value (for example ΔPitch or ΔEGain, etc.) of each EpR parameter at the current time is obtained by the method described before. In this process, the delta value is obtained in accordance with the value of PitchDepth [cent] and TremoloDepth [cent] as described before. Then the process proceeds to the next Step SA17.

Figure 8:
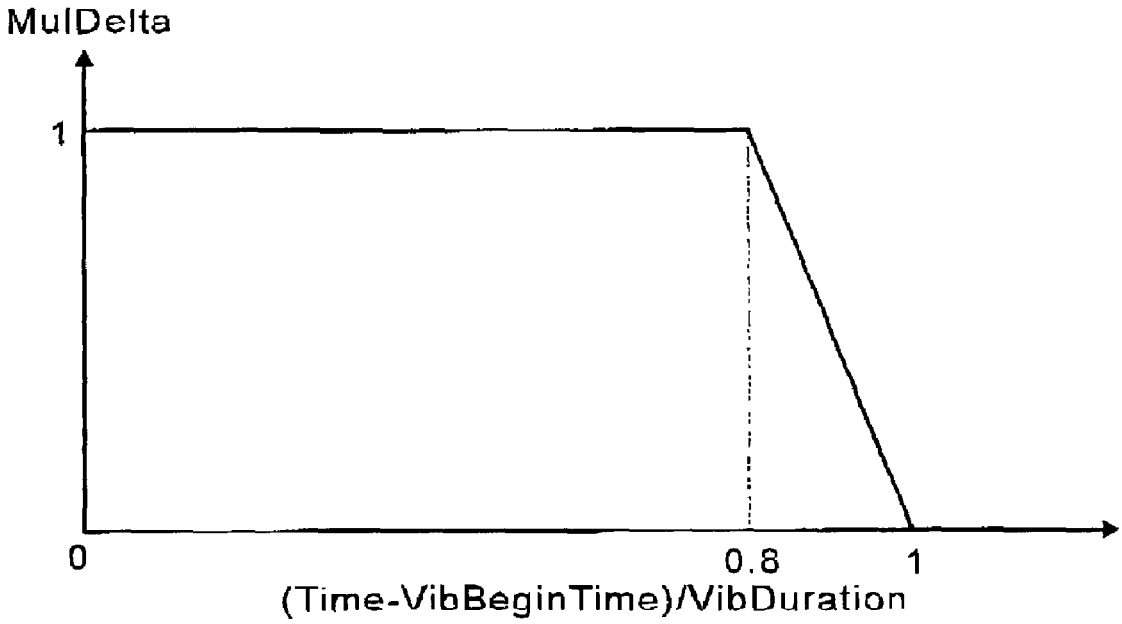
FIG. 8 is a graph showing an example of a coefficient MulDelta.

At Step SA17, A coefficient MulDelta is obtained as shown in FIG. 8. MulDelta is a coefficient for settling the vibrato effect by gradually declining the delta value of the EpR parameter when the elapsed time (Time [s]—VibBeginTime [s]) reaches, for example, 80% of the duration of the desired vibrato effect (VibDuration [s]). Then the process proceeds to the next Step SA18.

At Step SA18, the delta value of the EpR parameter obtained at Step SA16 is multiplied by the coefficient MulDelta. Then the process proceeds to Step SA19.

The processes in the above Step SA17 and Step SA18 are performed in order to avoid the rapid change in the pitch, volume, etc. at the time of reaching the vibrato duration.

The rapid change of the EpR parameter at the time of the vibrato ending can be avoided by multiplying the coefficient MulDelta to the delta value of the EpR parameter and decreasing the delta value from one position in the vibrato duration. Therefore, vibrato can be ended naturally without the vibrato release part.

At Step SA19, a new EpR parameter is generated by adding a delta value multiplied the coefficient MulDelta at Step SA18 to each EpR parameter value provided from the feature parameter generating unit 4 in FID. 1. Then the process proceeds to the next Step SA20.

At Step SA20, the new EpR parameter generated at Step SA19 is output to an EpR synthesizing engine 6 in FIG. 1. Then the process proceeds to the next Step SA21, and the vibrato adding process is ended.

Figure 9:
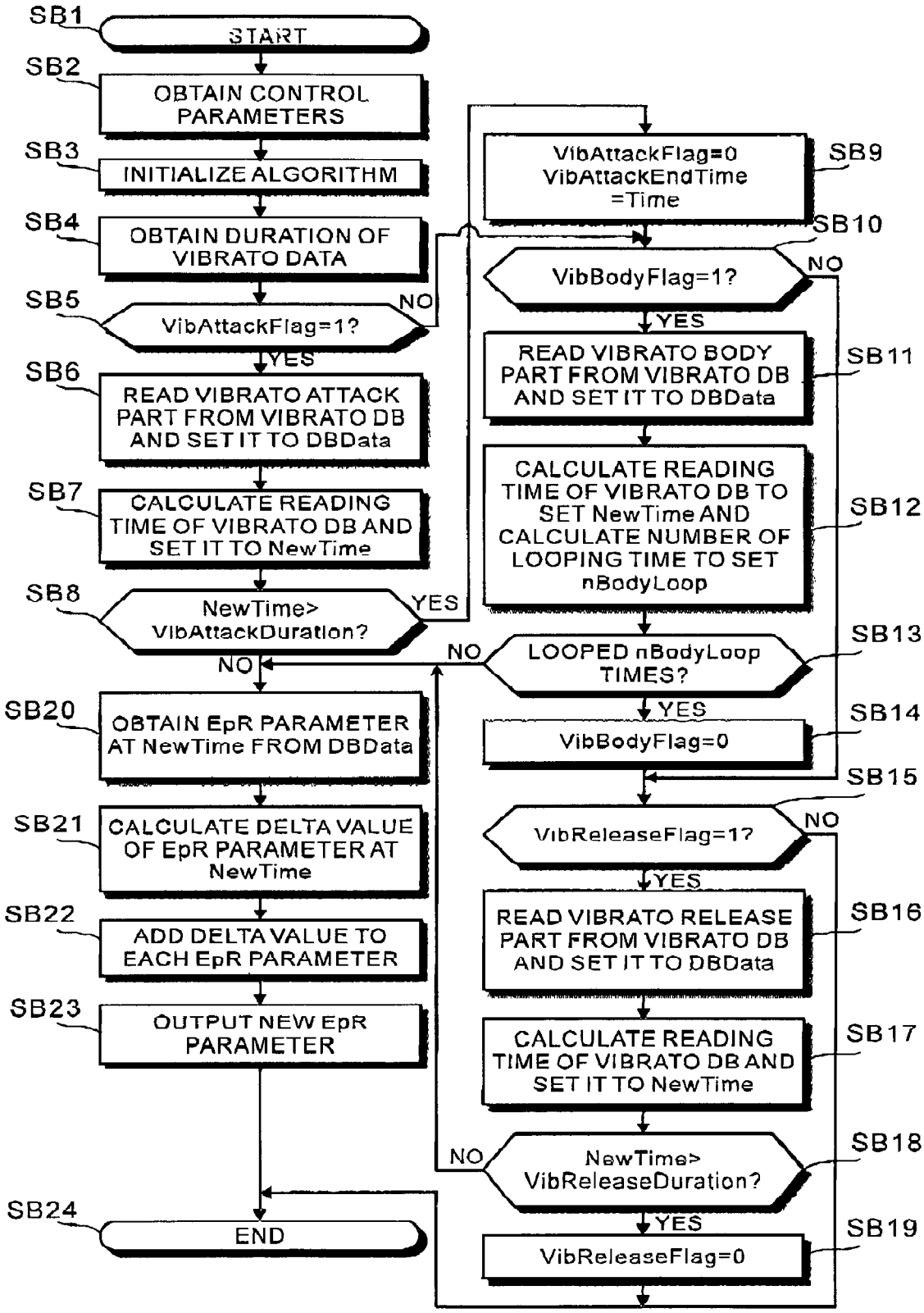
FIG. 9 is a flow chart showing the vibrato adding process in the case that a vibrato release performed in a vibrato adding part 5 of a voice synthesizing apparatus in FIG. 1 is used.

FIG. 9 is a flow chart showing the vibrato adding process in the case that a vibrato release performed in a vibrato adding part 5 of a voice synthesizing apparatus in FIG. 1 is used. The EpR parameter at the current time Time [s] is always input in the vibrato adding part 5 from the feature parameter generating unit 4 in FIG. 1.

At Step SB1, the vibrato adding process is started and it proceeds to the next Step SB2.

At Step SB2, a control parameter for the vibrato adding input from the data input part in FIG. 1 is obtained. The control parameter to be input is the same as that to be input at Step SA2 in FIG. 7.

That is, a vibrato effect is added to the EpR parameter to be provided from the feature parameter generating unit 4 between Time [s]=VibBeginTime [s] and Time [s]=(VibBeginTime [s]+VibDuration [s]) in the vibrato adding part 5.

At Step SB3, the algorithm for vibrato addition is initialized when the current time Time [s]=VibBeginTime [s]. In this process, for examples, the flag VibAttackFlag, the flag VibBodyFlag and the flag VibReleaseFlag is set to "1". Then the process proceeds to the next Step SB4.

At Step SB4, a vibrato data set matching to the current synthesizing pitch of the vibrato database in the database 3 in FIG. 1, and a vibrato data duration to be used is obtained. The duration of the vibrato attack part is set to be VibAttackEDuration [s], the duration of the vibrato body part is set to be VibBodyDuration [s], and the duration of the vibrato release part is set to be VibReleaseDuration [s]. Then the process proceeds to the next Step SB5.

At Step SB5, the flag VibAttackFlag is checked. When the flag VibAttackFlag=1, the process proceeds to a Step SB6 indicated by an YES arrow. When the flag VibAttackFlag=0, the process proceeds to a Step SB10 indicated by a NO arrow.

At Step SB6, the vibrato attack part is read from the vibrato database VDB and set to DBData. Then the process proceeds to the next Step SB7.

At Step SB7, VibFateFactor is calculated by the before-described equation (10). Further, a reading time (velocity) of the vibrato database VDB is calculated by the before-described equation (11), and the result is set to be NewTime [s]. Then the process proceeds to the next Step SB8.

At Step SB8, NewTime [s] calculated at Step SB7 is compared to the duration of the vibrato attack part VibAttackDuration [s]. When NewTime [s] exceeds VibAttackDuration [s] (NewTime [s]>VibAttackDuration [s]), that is, when the vibrato attack part is used from the beginning to the ending, the process proceeds Step SB9 indicated by an YES arrow for adding vibrato using the vibrato body part. When NewTime [s] does not exceed VibAttackDuration [s], the process proceeds to Step SB20 indicated a NO arrow.

At Step SB9, the flag VibAttackFlag is set to "0", and the vibrato attack is ended. Further, the time at that time is set to be VibAttackEndTime [s]. Then the process proceeds to Step SB10.

At Stop SB10, the flag VibBodyFlag is checked. When the flag VibBodyFlag=1, the process proceeds to Step SB11 indicated by an YES arrow. When the flag VibBodyFlag=0, the vibrato adding process is considered to be finished, and the process proceeds to Step SB15 indicated by a NO arrow, At Step SB11, the vibrato body part is read from the vibrato database VDB and set to be DBData. Then the process proceeds to Step SB12.

At Step SB12, VibRateFactor is calculated by the above equation (10). Further, the reading time (velocity) of the vibrato database VDB is calculated by the above-described equations (14) to (17) which are same as Step SA12 to mirror-loop the vibrato body part, and the result is set to be NewTime [s].

Also, the number looped in the vibrato body part is calculated by, for example an equation in below (18). Then the process proceeds to the next Step SB13.

$$\text{If}((\text{VibDuration}*\text{VibRateFactor}-(\text{VibAttackDuration}+\text{VibReleaseDuration}))<0)\text{nBodyLoop}=0,$$

else $$n\text{BodyLoop}=(\text{int})((\text{VibDuration}*\text{VibRateFactor}-(\text{VibAttackDuration}+\text{VibReleaseDuration}))/\text{VibBodyDuration}) \quad (18)$$

At Step SB13, whether after going into the vibrato body is more than the number of times of a loop (nBodyLoop) is detected. When the number of times of a repetition of the vibrato is more than the number of times of a loop (nBodyLoop), the process proceeds to Step SB14 indicated by an YES arrow. When the number of times of a repetition of the vibrato is not more than the number of times of a loop (nBodyLoop), the process proceeds to Step SB20 indicated by a NO arrow.

At Step SB14, the flag VibBodyFlag is set to "0", and using the vibrato body is ended. Then the process proceeds to Step SB15.

At Step SB15, the flag VibReleaseFlag is checked. When the flag VibReleaseFlag=1, the process proceeds to a Step SB16 indicated by an YES arrow. When the flag VibReleaseFlag=0, the process proceeds to a Step SB24 indicated by a NO arrow.

At Step SB16, the vibrato release part is read from the vibrato database VDB and set to be DBData. Then the process proceeds to Step SB17.

At Step SB17, VibRateFactor is calculated by the above equation (10). Further, a reading time (velocity) of the vibrato database VD8 is calculated by the above-described equation (11), and the result is set to be NewTime [s]. Then the process proceeds to the next Step SB18.

At step SB18, NewTime [s] calculated at Step SB17 is compared to the duration of the vibrato release part VibReleaseDuration [s]. When NewTime [s] exceeds VibReleaseDuration [s] (NewTime [s]>VibReleaseDuration [s]), that is, when the vibrato attack part is used from the beginning to the ending, the process proceeds Step SB19 indicated by an YES arrow for adding vibrato using the vibrato release part. When NewTime [s] does not exceed VibReleaseDurarion [s], the process proceeds to Step SB20 indicated a NO arrow.

At Step SB19, the flag VibReleaseFlag is set to "0", and the vibrato release is ended. Then the process proceeds to Step SB24.

Epr parameter (Pitch, EGain, etc.) at the time New time [s] is obtained from DBData. When the time NewTime [s] is the center of the flame time in an actual data in DBData, the EpR parameters in the frames before and after the time NewTime [s] is calculated by an interpolation (e.g., the line interpolation). Then, the process proceeds to Step SA21.

When the process has been proceeded by following the "NO" arrow at Step SB8, DBData is the vibrato attack DB. And when the process has been proceeded by following the "NO" arrow at Step SB13, DBData is the vibrato body DB, and when the process has been proceeded by following the "NO" arrow at Step SB18, DBData is the vibrato release DB.

At Step SA16, a delta value (for example ΔPitch or ΔEGain, etc.) of each EpR parameter at the current time is obtained by the method described before. In this process, the delta value is obtained in accordance with the value of PitchDepth [cent] and TremoloDepth [cent] as described the above. Then the process proceeds to the next Step SB22.

At Step SB22, a delta value of EpR parameter obtained at Step SB21 is added to each parameter value provided from the feature parameter generating unit 4 in FIG. 1, and a new EpR parameter is generated. Then the process proceeds to the next Step SB23.

At Step SB23, the new EpR parameter generated at Step SB22 is output to the EpR synthesizing engine 6 in FIG. 1.

Then the process proceeds to the next Step SB24, and the vibrato adding process is ended.

As above, according to the embodiment of the present invention, a real vibrato can be added to the synthesizing voice by using the database which is divided the EpR analyzed data of the vibrato-added reall voice into the attack part, the body part and the release part at the time of voice synthesizing.

Also, according to the embodiment of the present invention, although when the vibrato parameter (for example, the pitch or the like) based on a real voice stored in the original database is leaned, a parameter change removed the lean can be given at the time of the synthesis. Therefore, more natural and ideal vibrato can be added.

Also, according to the embodiment of the present invention, although when the vibrato release part is not used, vibrato can be attenuated by multiplying the delta value of the EpR parameter by the coefficient MulDelta and decreasing the delta value from one position in the vibrato duration. Vibrato can be ended naturally by removing the rapid change of the EpR parameter at the time of the vibrato ending.

Also, according to the embodiment of the present invention, since the database is created for the beginning and the ending of the vibrato body part to take the maximum value of the parameter, a vibrato body part can be repeated only by reading time backward at the time of the mirror loop of the vibrato body part without changing the value of the parameter.

Further, the embodiment of the present invention can also be used in a karaoke system or the like. In that case, a vibrato database is prepared to the karaoke system in advance, and EpR parameter is obtained by an EpR analysis of the voice to be input in real time. Then a vibrato addition process may be manipulated by the same method as that of the embodiment of the present invention to the EpR parameter. By doing that, a real vibrato can be added to the karaoke, for example, a vibrato to a song by an unskilled singer in singing technique can be added as if a professional singer sings.

However the embodiment of the present invention mainly explains the synthesized song voice, voice in usual conversations, sounds of musical instruments can also be synthesized.

Further, the embodiment of the present invention can be realized by a computer on the market that is installed a computer program or the like corresponding to the embodiment of the present invention.

In that case, it is provided a storage medium that a computer can read, such as CD-ROM. Floppy disk, etc., storing a computer program for realizing the embodiment of the present invention.

When the computer or the like is connected to a communication network such as the LAN, the Internet, a telephone circuit, the computer program, various kinds of data, etc., may be provided to the computer or the like via the communication network.

The present invention has been described in connection with the preferred embodiments. The invention is not limited only to the above embodiments. It is apparent that various modifications, improvements, combinations, and the like can be made by those skilled in the art.

What is claimed is:

1. A voice synthesizing apparatus for synthesizing a voice with vibrato in accordance with input information, said apparatus comprising:

a storage device that stores a first database, a second database and a third database, wherein said first database stores a first EpR parameter in each phoneme, which is obtained by resolving a spectrum envelope of harmonic components obtained by analyzing a voice, wherein said a second database stores a second EpR parameter obtained by analyzing a voice with vibrato, wherein said third database stores a template indicative of time sequential changes of an EpR parameter, and wherein each of said first and second EpR parameters includes an envelope of excitation waveform spectrum, excitation resonances, formants and a differential spectrum;

an input device that inputs voice information including information for specifying a pitch, dynamics, and phoneme of an output voice to be synthesized and a control parameter for adding vibrato to the output voice to be synthesized;

a generating device that reads out the first EpR parameter and the template from the storage device in accordance with the input voice information and applies the read-out template to the read-out first EpR parameter in order to generate a third EpR parameter;

a vibrato adding device that reads out the second EpR parameter from the storage device in accordance with the control parameter, calculates an additional value based on the second EpR parameter and adds the calculated additional value to the third EpR parameter; and a synthesizing device that synthesizes the output voice with vibrato in accordance with the voice information and the third EpR parameter to which the calculated additional value is added.

2. A voice synthesizing apparatus according to claim 1, wherein the storage device stores the second EpR parameter for each of attack part and body part.

3. A voice synthesizing apparatus according to claim 1, wherein the storage device stores the second EpR parameter for each of attack part, body part and release part.

4. A voice synthesizing apparatus according to claim 1, wherein a beginning point or an ending point of the second EpR parameter is a maximum value of the second EpR parameter.

5. A voice synthesizing apparatus according to claim 1, wherein the additional value calculated based on the second EpR parameter is a difference value from a predetermined value.

6. A voice synthesizing apparatus according to claim 1, wherein the control parameter includes parameters representing a vibrato beginning time, vibrato time length, vibrato rate, vibrato depth and tremolo depth.

7. A voice synthesizing apparatus according to claim 1, wherein the second EpR parameter includes parameters relating to a pitch and gain relating to vibrato.

8. A method of synthesizing a voice with vibrato in accordance with voice information, the method comprising:

(a) inputting the voice information including information for specifying a pitch, dynamics, and phoneme of an output voice to be synthesized and a control parameter for adding vibrato to the output voice to be synthesized;

(b) reading, from a storage device that stores a first database, a second database, and a third database, wherein said first database stores a first EpR parameter in each phoneme, which is obtained by resolving a spectrum envelope of harmonic components obtained by analyzing a voice, wherein said second database stores a second EpR parameter obtained by analyzing a voice with vibrato, wherein said third database stores a template indicative of time sequential changes of an EpR parameter, and each of said first and second EpR parameters includes an envelope of excitation waveform spectrum, excitation resonances, formants and differential spectrum;

(c) generating a third EpR parameter by reading out the first EpR parameter and the template from the storage device in accordance with the input voice information and applies the read-out template to the read-out first EpR parameter;

(d) reading out the second EpR parameter from the storage device in accordance with the control parameter, calculating an additional value based on the second EpR parameter and adding the calculated additional value to the third EpR parameter; and (e) synthesizing the output voice with vibrato in accordance with the input voice information and the third EpR parameter to which the calculated additional value is added.

9. A computer-readable medium having instructions thereon which, when executed, cause a computer to perform a process for synthesizing a voice with vibrato in accordance with voice information, the process comprising:

(a) inputting the voice information including information for specifying a pitch, dynamics, and phoneme of an output voice to be synthesized and a control parameter for adding vibrato to the output voice to be synthesized;

(b) reading, from a storage device that stores a first database, a second database, and a third database, wherein said first database stores a first EpR parameter in each phoneme, which is obtained by resolving a spectrum envelope of harmonic components obtained by analyzing a voice, wherein said second database stores a second EpR parameter obtained by analyzing a voice with vibrato, wherein said third database stores a template indicative of time sequential changes of an EpR parameter, and each of said first and second EpR parameters includes an envelope of excitation waveform spectrum, excitation resonances, formants and differential spectrum;

(c) generating a third EpR parameter by reading out the first EpR parameter and the template from the storage device in accordance with the input voice information and applies the read-out template to the read-out first EpR parameter;

(d) reading out the second EpR parameter from the storage device in accordance with the control parameter, calculating an additional value based on the second EpR parameter and adding the calculated additional value to the third EpR parameter; and (e) synthesizing the output voice with vibrato in accordance with the input voice information and the third EpR parameter to which the calculated additional value is added.

10. A voice synthesizing apparatus according to claim 2, wherein said vibrato adding device reads out the second EpR parameter for each of the attack part and the body part from the storage device in accordance with the control parameter, calculates the additional value longer than a duration of the body part of the second EpR parameter by looping the body part of the second EpR parameter.

11. A voice synthesizing apparatus according to claim 10, wherein an offset subtraction process is performed to the body part of the second EpR parameter before the additional value is calculated.

* * * * *